US005996843A

United States Patent [19]

Hough

[11] Patent Number: 5,996,843

[45] Date of Patent: Dec. 7, 1999

[54] CENTRALIZED FUEL TANK SUBMERSIBLE PUMP CONTROL

[75] Inventor: Wendell Lane Hough, Bertram, Tex.

[73] Assignee: Dresser Industries, Inc., Dallas, Tex.

[21] Appl. No.: 09/041,144

[22] Filed: Mar. 12, 1998

Related U.S. Application Data

[60] Provisional application No. 60/041,720, Mar. 27, 1997.

[51] Int. Cl.[6] ..... B67D 5/16

[52] U.S. Cl. ..... 222/71; 222/14; 222/75; 222/145.4

[58] Field of Search ..... 222/14, 16, 17, 222/71, 74, 75, 129, 145.4

[56] References Cited

U.S. PATENT DOCUMENTS

| | | | |
|---|---|---|---|
| 3,771,697 | 11/1973 | Sasnett, Jr. et al. | 222/16 |
| 4,067,486 | 1/1978 | Hyde et al. | 222/26 |
| 4,107,777 | 8/1978 | Pearson et al. | 364/465 |
| 4,131,215 | 12/1978 | Hansel | 222/145.4 |
| 4,247,899 | 1/1981 | Schiller et al. | 364/465 |
| 4,250,550 | 2/1981 | Fleischer | 364/536 |
| 5,163,586 | 11/1992 | Zinsmeyer | 222/14 |
| 5,257,720 | 11/1993 | Wulc et al. | 222/71 |
| 5,361,216 | 11/1994 | Warn et al. | 364/510 |
| 5,394,336 | 2/1995 | Warn et al. | 364/479 |
| 5,557,529 | 9/1996 | Warn et al. | 364/479.02 |
| 5,630,528 | 5/1997 | Nanaji | 222/71 |
| 5,659,482 | 8/1997 | Warn et al. | 364/479.06 |
| 5,663,887 | 9/1997 | Warn et al. | 364/479.02 |
| 5,694,326 | 12/1997 | Warn et al. | 364/479.01 |
| 5,790,410 | 8/1998 | Warn et al. | 364/479.02 |
| 5,794,667 | 8/1998 | Payne et al. | 222/71 |

*Primary Examiner*—Joseph A. Kaufman
*Attorney, Agent, or Firm*—Haynes & Boone, L.L.P.

[57] ABSTRACT

A system for pumping a selected fuel product from a storage tank to a dispenser includes a site controller, several fuel dispensers, each operable for dispensing a selected fuel product, and a data link connected to convey product information from a selected dispenser to the site controller. Several storage tanks each contain a different fuel product from each other tank, and also contain a submersible pump in each tank. A relay is connected to each pump. A submersible pump controller (SPC) is connected to each relay and the site controller. The SPC may also be connected to each dispenser. The SPC receives product selection information from the site controller and activates the relay connected to the pump in the storage tank containing the selected product, whereby the selected fuel product is pumped to the selected dispenser.

19 Claims, 2 Drawing Sheets

CENTRALIZED FUEL TANK SUBMERSIBLE PUMP CONTROL

CROSS-REFERENCE RELATED DATA

This application claims the benefit of provisional patent application Ser. No. 60/041,720, filed on Mar. 27, 1997.

BACKGROUND OF THE INVENTION

The disclosures herein relate generally to fuel dispensers and more particularly to multiple grade fuel dispensers which deliver different grade fuel from separate storage tanks.

Multiple grade fuel dispensers, of the type commonly used at gas stations, have a plurality of hoses with delivery nozzles at each dispenser unit. Each nozzle delivers a different grade of fuel from a storage tank in the ground. There is usually no actual pump in the dispenser unit. Instead, a submersible pump is located in each tank. When a product is selected at the dispenser, the pump will engage and pressurize the fuel line, and the fuel will flow through the line and go to the designated dispenser.

In the typical system including several multiple grade dispensers, there is usually a main feeder pipe from the storage tank for each grade. Several branch lines link the main feeder pipe with each dispenser. There is only one pump for each storage tank however, which supplies multiple dispensers. This requires a system to allow each dispenser to access the pump. This is accomplished by, for example, a 120 volt AC line connecting the dispenser to a relay which feeds power to the submersible pump located in the storage tank, see FIG. 1. Each dispenser that uses a particular storage tank will have a 120 volt line connected in parallel with the other lines to that relay. As long as there is at least one dispenser using a storage tank, the respective relay will remain engaged. Therefore, a three hose dispenser, i.e., a dispenser which dispenses three grades of fuel, requires three separate 120 volt lines feeding back to a common location, usually located inside the gas station, operably connected to a relay associated with each pump. With the requirement that power for the fuel tank submersible pump relays be supplied by the dispensers, and an individual wire for each tank that is to be controlled, each dispenser is a potential failure point.

Each dispenser carries a serial communication data link which is used by the site controller, cash register, or whatever, to exchange information with the dispenser. Some of the information identifies what the product is, i.e., which grade of fuel. The site controller is able to detect which tank will be accessed when a product is selected, but each dispenser believes it is the only user of a tank.

Thus, present systems include dispensers located at various service islands, the indoor site controller, the communication link interconnecting all of the dispensers with the site controller, each dispenser having a wire connected to the relay to pass power to the submersible pump.

It would be beneficial to shift the responsibility for turning on the submersible pump relay from the dispenser to the site controller. This would eliminate the need for individual submersible pump control wiring from the dispensers to the pump control relays and would simplify dispenser installation, reduce product costs and diminish problems associated with AC voltage feeding back to the dispensers from the relays. Also, it would be beneficial to be able to retro-fit present installations to use existing hardware to function in this manner without the need to install new re-wiring arrangements between the dispensers and the site controller.

Therefore, what is needed is a method and apparatus which provides that the site controller have the ability to detect product selection at the fuel dispenser which results in a change in the state of the submersible pump located in the storage tank holding the selected product. The site controller can then pass the selection information over the serial data link to control the relays and turn the submersible pumps on and off as necessary to control fuel delivery to the dispensers.

SUMMARY OF THE INVENTION

One embodiment accordingly, provides a method and an apparatus for dispensing multiple grades of fuel from different storage tanks in a manner which provides the site controller with direct control over the pumps in the tanks so that the dispensers no longer have discrete control over the pumps. To this end, a system for pumping a selected fuel product from a storage tank to a dispenser includes a site controller and a plurality of dispensers, each dispenser provided to dispense a selected fuel product. A data link is connected to convey product selection information from a selected dispenser to the site controller. A plurality of storage tanks each contain a different fuel product from each other tank and a submersible pump is provided in each tank. A relay is connected to each pump. A device is connected to each relay and the site controller for receiving product selection information from the site controller and for activating the relay connected to the pump in the storage tank containing the selected product, whereby the selected fuel product is pumped to the selected dispenser.

A principal advantage of this embodiment is that the site controller detects product selection at the fuel dispenser which changes the state of the submersible pump located in the storage tank holding the selected product. The site controller passes the selection information over the data link to control the relays to turn the submersible pumps on and off as necessary to control fuel delivery to the dispensers. Thus, the responsibility for turning on the submersible pump is shifted from the dispenser to the site controller.

Another advantage is that this eliminates the need for individual submersible pump control wiring from the dispensers to the pump control relays and simplifies dispenser installation, reduces product costs and diminishes problems associated with AC voltage feeding back to the dispensers from the relays.

DETAILED DESCRIPTION OF THE PREFERRED EMBODIMENT

Figure 1:
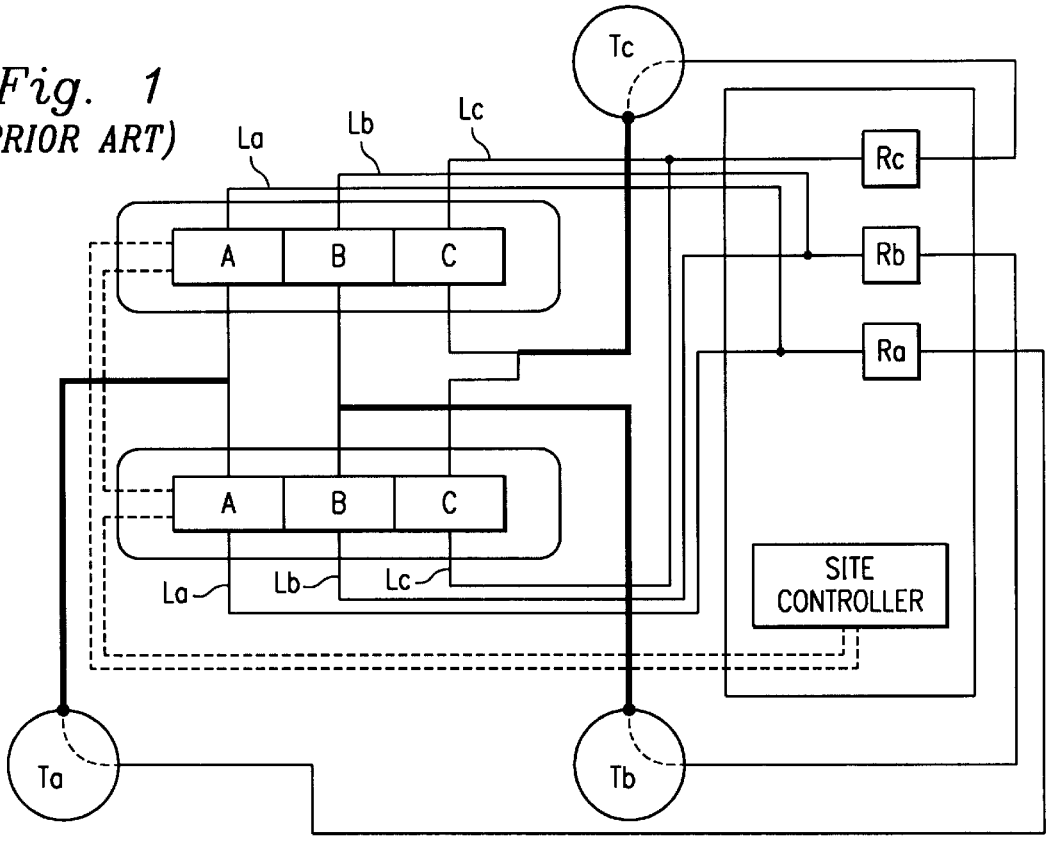
Fig. 1 (PRIOR ART)
FIG. 1 is a schematic view illustrating a prior art refueling site.

In the prior art embodiment illustrated in FIG. 1, dispenser portions A, B, C are connected to receive selected fuel, respectively, from storage tanks Ta, Tb, Tc. Each dispenser portion A, B, C is respectively connected to a relay Ra, Rb, Rc by 120 volt AC lines La, Lb, Lc. If applicable, another voltage appropriate for a particular system, may be used.

Figure 2:
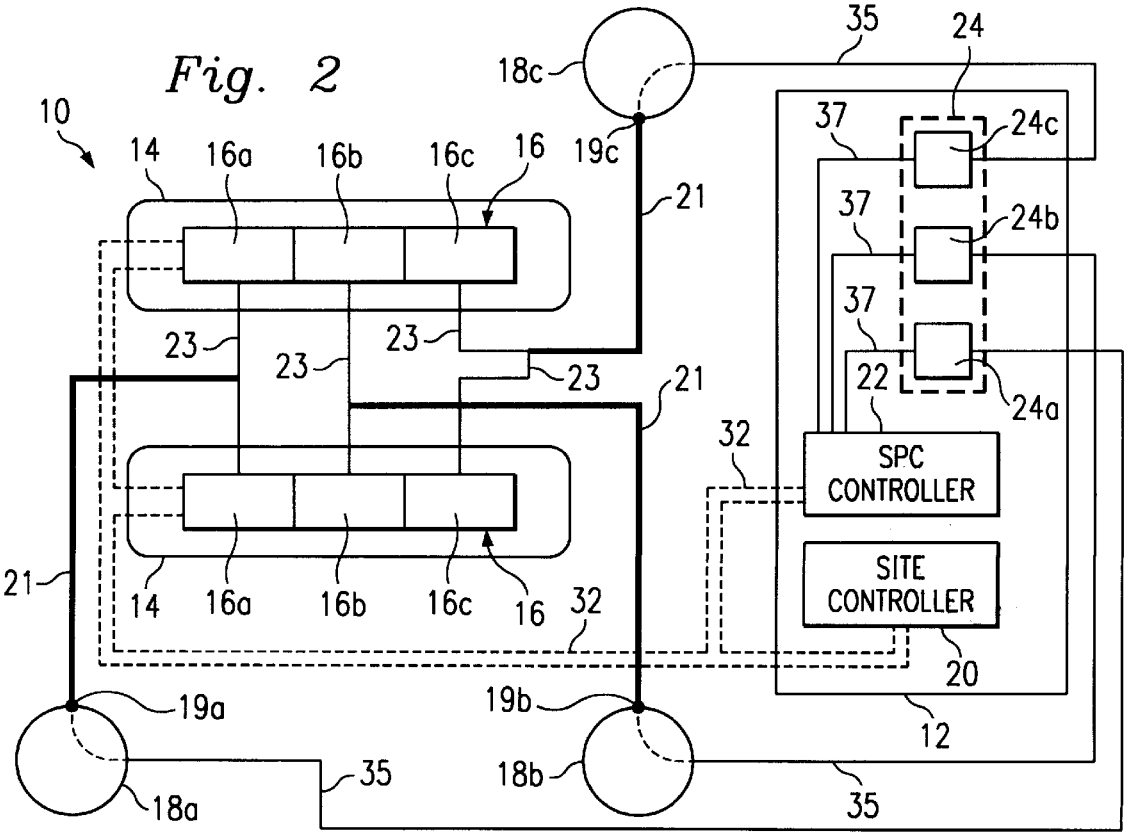
FIG. 2 is a schematic view illustrating an embodiment of the system of this invention.

A refueling site is generally designated 10 in the present invention illustrated in FIG. 2, and includes a main building structure 12 and remote refueling islands 14. Each island has fuel dispenser units 16 for dispensing multiple grades of fuel. Commonly, three grades of fuel are available at each dispenser unit. Therefore, three dispenser portions 16*a*, 16*b*, 16*c* are provided with respective hoses and nozzles for dispensing the three fuel grades at each unit. Each dispenser portion contains a dispenser control unit or computer base as is well known (not shown). Although multiple product dispensers are discussed, the present invention may be used with a single product dispenser.

Fuel for the three grades is stored in three separate storage tanks 18*a*, 18*b*, 18*c*, which are buried in the ground. A main feeder line 21 is connected to each tank and branch lines 23 connect each feeder with each dispenser unit therefore making fuel from tank 18*a* available to each unit 16 having a portion 16*a*, making fuel from tank 18*b* available to each unit 16 having a portion 16*b* and making fuel from tank 18*c* available to each unit 16 having a portion 16*c*. A submersible pump 19*a*, 19*b*, 19*c* is respectively located in each tank 18*a*, 18*b*, 18*c*. Within building structure 12 is a site controller 20, a submersible pump controller (SPC) 22 and a relay unit 24.

At site 10, a system is provided for pumping a selected fuel from a respective storage tank to an associated dispenser. The system includes the storage tanks 18*a*, 18*b*, 18*c*, respectively including the pumps 19*a*, 19*b*, 19*c*. The dispenser units 16 each include the dispenser portions 16*a*, 16*b*, 16*c*. The site controller 20 is connected to dispenser units 16 by a data link 32 which conveys product information from selected dispenser portions 16*a*, 16*b* or 16*c* to site controller 20. A plurality of relays 24*a*, 24*b*, 24*c* are included in relay unit 24. Each relay 24*a*, 24*b*, 24*c* is respectively connected to pumps 19*a*, 19*b*, 19*c*. In the examples illustrated, the relays 24*a*, 24*b*, 24*c* are powered by an AC power source, FIG. 3, to actuate switches 34 which energize the pumps 19*a*, 19*b*, 19*c* through appropriate connections 35. A means, such as the SPC 22 is connected to relays 24*a*, 24*b*, 24*c* by appropriate connections 37. SPC 22 is also connected by data link 32 to site controller 20, FIG. 2, and each dispenser unit 16, for receiving product selection information from site controller 20 and for activating the appropriate relays 24*a*, 24*b*, 24*c* connected to the respective pump 19*a*, 19*b*, 19*c* in the associated storage tanks 18*a*, 18*b*, 18*c* containing the product. In this manner, selected product is then pumped from the tanks 18*a*, 18*b*, 18*c* to the associated dispenser portions 16*a*, 16*b*, 16*c*.

Figure 2A:
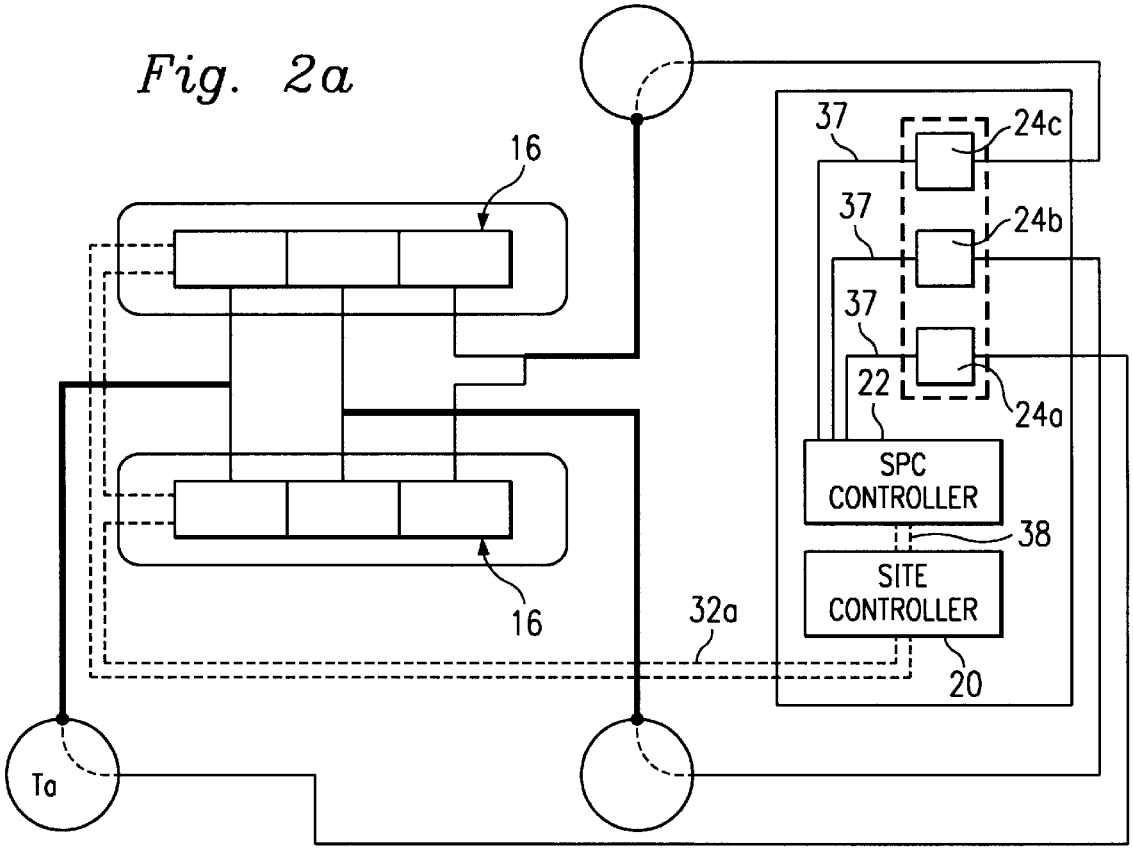
FIG. 2*a* is a schematic view illustrating an alternative embodiment of the system of this invention.

In the system illustrated in FIG. 2*a*, SPC 22 is connected to each relay 24*a*, 24*b*, 24*c* by connections 37 and to site controller 20 by an alternative connection 38. An alternative data link 32*a* only connects site controller 20 and dispenser units 16. However, the SPC 22 is not interconnected with dispenser units 16 by data link 32*a*.

The SPC 22, in the preferred embodiment of FIG. 2, is connected via data link 32 to site controller 20 and to dispensers 16*a*, 16*b*, 16*c*. The SPC 22 receives product selection information from site controller 20 and is connected to activate relays 24*a*, 24*b*, 24*c* connected to the corresponding pump 19*a*, 19*b*, 19*c* in associated storage tank 18*a*, 18*b*, 18*c* containing the selected product. The form of the information received on data link 32 is a two-wire, asynchronous, serial communication, or may be another communication or data link protocol in the SPC 22 which is compatible with the protocol of the dispenser portions 16*a*, 16*b*, 16*c*. In the alternate embodiment of FIG. 2*a*, any communication protocol compatible with the site controller 20 can be used. This is because in this embodiment, the SPC 22 is not linked directly to dispensers 16*a*, 16*b*, 16*c*.

Figure 3:
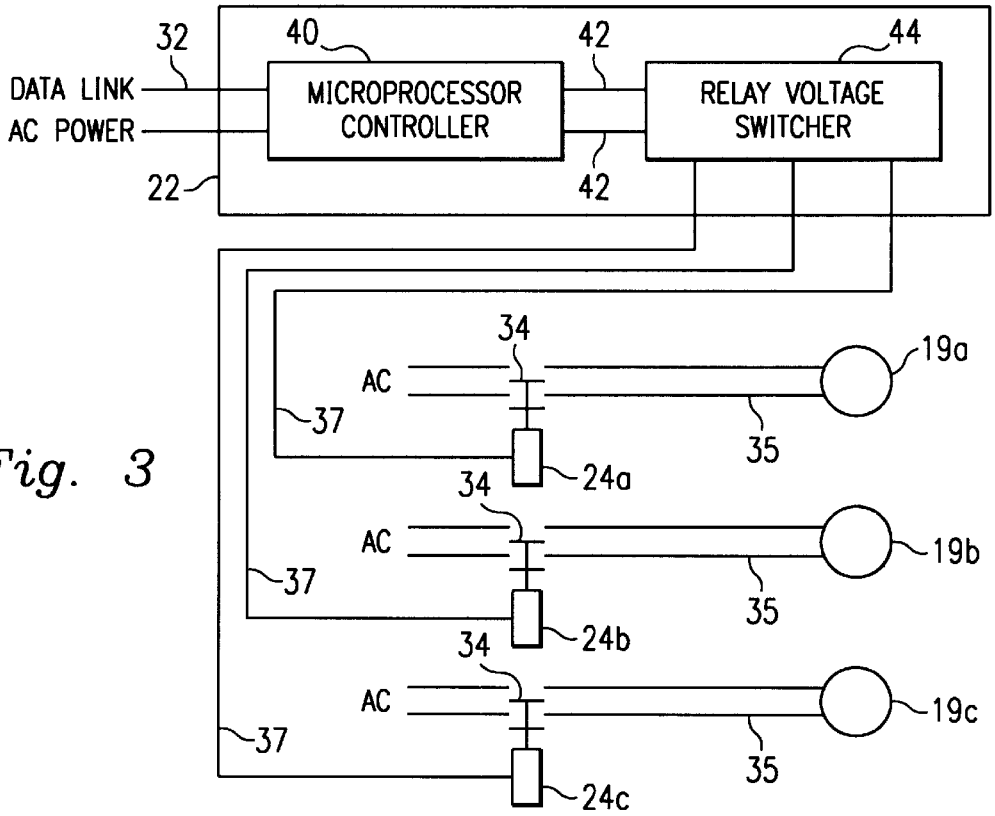
FIG. 3 is a schematic view illustrating an embodiment of the submersible pump controller of this invention.

The SPC 22, FIG. 3, includes a microprocessor controller 40, relay controls 42 and a relay voltage switcher 44. An AC power source provides power to the SPC 22. Data is received by the SPC 22 through the data link 32, FIG. 2, or alternatively through data link 38, FIG. 2*a*. The purpose of the microprocessor controller 40, FIG. 3, is to be able to evaluate the information received via data link 32 for the purpose of switching relays 24*a*, 24*b*, 24*c* on and off, and the purpose of the relay voltage switcher 44 is to switch those relays on and off.

Microprocessor controller 40 does not directly drive relays 24*a*, 24*b*, 24*c*, but acts through the relay voltage switcher 44, functioning as an interface, capable of taking some of the voltage input, i.e., whatever is necessary to drive relays 24*a*, 24*b*, 24*c*, and pass that voltage through to those relays. The relay controls 42 are used by the microprocessor controller 40 to enable the portion of the relay voltage switcher 44 that passes the appropriate voltage to the relays.

Therefore, if it is desired to switch a 120 volt relay, the microprocessor controller 40 determines the appropriate relay 24*a*, 24*b*, 24*c* to be enabled, the relay voltage switcher 44 feeds the 120 volts through to the appropriate relay 24*a*, 24*b*, 24*c*, which is actuated, and allows the main drive voltage (AC power) to be fed through the actuated relay to the associated submersible pump 19*a*, 19*b*, 19*c*. The type of relay 24*a*, 24*b*, 24*c* that is used to pass voltage to the submersible pump 19*a*, 19*b*, 19*c*, is dependent upon the type of motor in the submersible pump.

In operation, if a user selects a fuel product from, for example, dispenser portion 16*a*, the dispenser computer base which is monitoring external connections of the dispenser portion 16*a*, e.g., nozzle, selection switches, etc. (not shown), detects the product selection. The site controller 20 periodically interrogates each dispenser portion using data link 32, FIG. 2 or 32*a*, FIG. 2*a*. The selected dispenser portion 16*a* responds with the product identification that has been selected by the user. The site controller 20 uses information in its own internal database to determine that tank 18*a* will be supplying the fuel to the selected dispenser portion 16*a*. The site controller 20 communicates to the SPC 22 over data link 32, FIG. 2 or 38, FIG. 3, and delivers to the SPC 22 whatever information is necessary to determine that relay 24*a* should be energized. The SPC 22 energizes relay 24*a* which passes drive voltage to submersible pump 19*a* located in storage tank 18*a*, which stores the selected product. The system pressurizes, the selected product is delivered through the main feeder line 21, to the branch lines 23 and to the selected dispenser portion 16*a*.

Although illustrative embodiments have been shown and described, a wide range of modifications, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. A system for pumping a fuel product from a storage tank to a dispenser comprising:

a site controller;

a dispenser having means for dispensing a fuel product;

a data link connected to convey product information from the dispenser to the site controller;

a storage tank containing a fuel product;

a submersible pump in the tank;

a relay connected to the pump; and means connected to the relay and the site controller, for receiving information from the site controller and for activating the relay connected to the submersible pump in the storage tank containing the fuel product, wherein said means includes a microprocessor controller and a relay voltage switcher.

2. The system as defined in claim 1 wherein the data link is a serial data link.

3. The system as defined in claim 1 wherein the means connected to the relay and the site controller is also connected to the dispenser.

4. A system for pumping a selected fuel product from a storage tank to a dispenser comprising:

a site controller;

a plurality of dispensers, each dispenser having means for dispensing a selected fuel product;

a data link connected to convey product information from a selected dispenser to the site controller;

a plurality of storage tanks, each containing a different fuel product from each other tank;

a submersible pump in each tank;

a relay connected to each pump; and means connected to each relay and the site controller, for receiving product selection information from the site controller and for activating the relay connected to the submersible pump in the storage tank containing the selected product, wherein said means includes a microprocessor controller and a relay voltage switcher.

5. The system as defined in claim 4 wherein the data link is a serial data link.

6. The system as defined in claim 4 wherein the means connected to each relay and the site controller is also connected to each dispenser.

7. The system as defined in claim 4 further comprising a building structure for housing the site controller.

8. The system as defined in claim 7 further comprising refueling islands for supporting the dispensers.

9. The system as defined in claim 8 wherein the refueling islands are remote from the building structure.

10. The system as defined in claim 7 further comprising a relay unit in the building structure.

11. The system as defined in claim 10 wherein said means for receiving product selection information and for activating the relay further includes a submersible pump controller in the building structure.

12. The system as defined in claim 11 further comprising refueling islands for supporting the dispensers.

13. The system as defined in claim 12 wherein the refueling islands are remote from the building structure.

14. The system as defined in claim 10 wherein the site controller is connected directly to the submersible pump controller.

15. A system for pumping a selected fuel product from a storage tank to a dispenser comprising:

a site controller;

a plurality of dispensers, each dispenser having means for dispensing a selected fuel product;

a data link connected to convey product information from a selected dispenser to the site controller;

a plurality of storage tanks, each containing a different fuel product from each other tank;

a submersible pump in each tank;

a relay connected to each pump;

submersible pump controller means connected to each relay and the site controller, for receiving product selection information from the site controller and for activating the relay connected to the submersible pump in the storage tank containing the selected product;

a building structure for housing the site controller;

a relay unit in the building structure; and a microprocessor controller and a relay voltage switcher in the submersible pump controller.

16. The system as defined in claim 15 wherein the relay voltage switcher is connected to each relay.

17. A refueling site comprising:

a site controller;

a relay unit;

a plurality of dispensers, each dispenser having means for dispensing a selected fuel product;

a data link connected to convey product information from a selected dispenser to the site controller;

a plurality of storage tanks, each containing a different fuel product from each other tank;

a submersible pump in each tank;

a relay connected to each pump, each of said relays being housed in said relay unit; and a submersible pump controller interconnected with the relay unit and the site controller for receiving product selection information from the site controller and for activating the relay connected to the submersible pump in the storage tank containing the selected product, whereby the selected fuel product is pumped to the selected dispenser, wherein the submersible pump controller includes a microprocessor controller and a relay voltage switcher interconnected by relay controls.

18. A method of pumping a selected fuel product from a storage tank to a dispenser, comprising the steps of:

interconnecting a site controller and a plurality of dispensers by a data link;

connecting the data link to convey product information from a selected dispenser to the site controller;

providing a plurality of storage tanks, each tank including a different fuel product from each other tank;

providing a submersible pump in each tank;

connecting a relay to each pump;

connecting a submersible pump controller with each relay and with the site controller for receiving product selection information from the site controller and for activating the relay connected to the submersible pump in the storage tank containing the selected product, whereby the selected fuel product is pumped to the selected dispenser; and connecting a microprocessor controller to a relay voltage switcher.

19. The method as defined in claim 18 wherein said step of connecting the microprocessor controller to the relay voltage switcher includes connecting a microprocessor to a relay voltage switcher in the submersible pump controller.

* * * * *